US005099884A

United States Patent [19]

Monahan

[11] Patent Number: 5,099,884

[45] Date of Patent: Mar. 31, 1992

[54] ELECTRORHEOLOGICAL FLUID PLATE VALVE

[75] Inventor: Russell E. Monahan, Ann Arbor, Mich.

[73] Assignee: NTN Technical Center (U.S.A.), Inc., Ann Arbor, Mich.

[21] Appl. No.: 705,315

[22] Filed: May 24, 1991

[51] Int. Cl.[5] ..... F15C 1/04

[52] U.S. Cl. ..... 137/827; 251/129.01; 123/90.11; 188/267; 267/140.1

[58] Field of Search ..... 251/129.01; 248/566; 188/267, 269, 322.5; 267/140.1, 218; 137/827; 123/90.11

[56] References Cited

U.S. PATENT DOCUMENTS

| | | | |
|---|---|---|---|
| 4,757,981 | 7/1988 | Härtel | 188/322.5 |
| 4,896,752 | 1/1990 | Shtarkman | 188/267 |
| 4,909,489 | 3/1990 | Doi | 248/566 |
| 4,930,463 | 6/1990 | Hare, Sr. | 123/90.11 |

*Primary Examiner*—Noah P. Kamen
*Attorney, Agent, or Firm*—James M. Deimen

[57] ABSTRACT

A fluid control valve of "Wheatstone Bridge" arrangement for use with electrorheological fluids comprises a plurality of channel plates and printed circuit board plates alternatingly stacked together. Electrodes are printed on the printed circuit board plates to form walls on sides of channels formed in the channel plates. Holes piercing the printed circuit board plates are so located as to permit the flow of fluid through the printed circuit board plates from channel plate to channel plate at specific locations thereby causing the flow of fluid through a "Wheatstone Bridge" arrangement. Electric activation of selected electrodes cause the flow of fluid in channels between the selected electrodes to become exceedingly viscous or "freeze" and thereby close selected portions of the "Wheatstone Bridge". In the most common arrangement closure of parallel valves cause flow through the cross arm of the "Wheatstone Bridge" and actuation of an hydraulic device connected into the cross arm. The printed circuit board plates can be manufactured with conventional automated printed circuit manufacturing technology and the channel plates may be punched or otherwise formed with automated technology. Such parameters as pressure drop and capacity can be adjusted by changing the fluid, the number of sets, size, spacing and shape of alternating channel plates and printed circuit board plates.

21 Claims, 5 Drawing Sheets

ELECTRORHEOLOGICAL FLUID PLATE VALVE

BACKGROUND OF THE INVENTION

The field of the invention pertains generally to hydraulic control mechanisms and, in particular, to fluid control valves for the modulation of hydraulic power. More recently the development of electrorheological fluids has permitted the corresponding development of simple fluid plate valves. These valves comprise a plurality of electroconductive plates separated by insulative plates. The insulative plates include passages formed therein that lead between ports through the conductive plates. Alternating conductive plates are electrically joined in parallel whereby the application of an electric potential between the two sets of conductive plates causes an electric filed to be energized between adjacent conductive plates and through the passages in the insulative plates therebetween. With the application of the electric field a great increase in viscosity occurs in the electrorheological fluid in the passages and the valve effectively closes.

A small variety of devices have been disclosed that advantageously use electrorheological fluids. U.S. Pat. No. 4,896,754 discloses electromagnetic power transmissions and brakes that take advantage of multiple alternating flat discs in a chamber filled with an electrorheological fluid. The level of torque transmitted or braking applied is responsive to the selective and variable application of an electric filed applied to the electrorheological fluid.

U.S. Pat. No. 4,923,057 discloses the use of an electrorheological fluid in an enclosed chamber as a part of a vibration damping structure. The application of an electric field to the electrorheological fluid within the structure makes substantial change in the complex shear and tensile modulus properties of the fluid therefore the damping characteristics of the structure are greatly changed.

U.S. Pat. No. 4,819,772 discloses an automotive shock absorber filled with an electrorheological damping fluid. Electrodes about a damping fluid conduit permit an applied electric field to adjust the damping of the shock absorber. U.S. Pat. No. 4,861,006 discloses a vibration damper wherein the flow of an electrorheological fluid through an elongated orifice is adjusted by changing the apparent viscosity of the fluid with an electric field. In a similar manner U.S. Pat. No. 4,909,489 discloses the control of the flow of an electrorheological fluid through helical orifices to adjust the vibration damping of an internal combustion engine mount.

U.S. Pat. No. 4,720,087 and U.S. Pat. No. 4,733,758 are related patents disclosing vibration dampers wherein the viscosity of the electrorheological fluid is adjusted in the flow through valves in the dampers. U.S. Pat. No. 4,742,998 discloses a vibration isolation system wherein an active electronic feedback control adjusts the voltage potential applied to the electrorheological fluid in response to sensors on the vibration damper. Also disclosed is a multiple orifice valve comprising parallel conductive perforated flat plates separated by an insulated plate formed with flow channels.

The above patents disclose devices that control the flow of electrorheological fluid through simple orifices and valves or control the torque transmitted between moving plates in an electrorheological fluid bath. The control of the flow of electrorheological fluid in a sophisticated manner through sophisticated valve combinations for the control of hydraulic cylinders and rotary actuators is the goal toward which the disclosure below is directed.

SUMMARY OF THE INVENTION

The invention comprises an electrorheological fluid control valve of the "Wheatstone Bridge" arrangement that is intended for use as a general hydraulic control mechanism. In particular, the new fluid control valve is intended to accurately modulate the flow of hydraulic power to an hydraulic cylinder, rotary actuator, motor or other power transmission device. The "Wheatstone Bridge" arrangement permits two separate electric signals to control the flow of electrorheological fluid through the legs of the bridge. Precise control of the hydraulic cylinder, rotary actuator, motor or other power transmission device is possible because the apparent viscosity of the electrorheological fluid changes almost instantly in response to changes in the electric field penetrating the fluid.

Briefly, the new valve incorporated four valves in one valve body to minimize overall size and volume, number of internal connections and ports, and eliminate moving parts. The valve comprises the stacking of four types of plates. In particular they are cover plates, channel plates, ground plates and printed circuit board plates. The plates are interchangeable and simple in design being merely stacked together sufficiently tight to prevent leakage from the valve or cross channel leakage with the valve.

The channel plates and printed circuit board plates are of high strength non-conductive material and the ground plates of thin stamped sheet metal. The printed circuit board plates are printed with the specific electrodes required on both sides so that channel plates and printed circuit board plates can alternate in the stack in modular fashion. The cover plate is attached at one end of the stack with the ground plate at the other end of the stack to complete the valve. Thus, using printed circuit board technology to produce the electrodes, the valve can be produced in great quantities at low cost. Moreover, as shown below, by oversizing the electrodes, the electrodes serve as seals and gaskets for the channels in the channel plates. A great advantage to the new valve is the complete elimination of all moving parts.

the new "Wheatstone Bridge" valve is particularly adapted to active vehicle suspension systems, engine intake and exhaust valve control, robotics and manipulators, or any hydraulic application that uses a double acting cylinder, rotary actuator or reversible motor. For these applications, valve porting is minimized because only four valve ports are required. The new valve is not limited to these examples but may also be applied to other hydraulic or fluid control systems.

Maximum valve capacity can be varied by changing the fluid, the number of sets, size, spacing and shape of alternating channel plates and printed circuit board plates. The effective length of the fluid path between the electrodes is thereby changed. The pressure drop across the valve can be varied by changing the thickness of the channel plates, the width of the channels and the flow area of the ports. Since each printed circuit board plate is subjected to only a fraction of the total pressure drop through the valve, strength and sealing requirements are minimized. Other important features and advantages of the new valve are described in the detailed explanation below.

DESCRIPTION OF THE PREFERRED EMBODIMENTS

Figure 1:
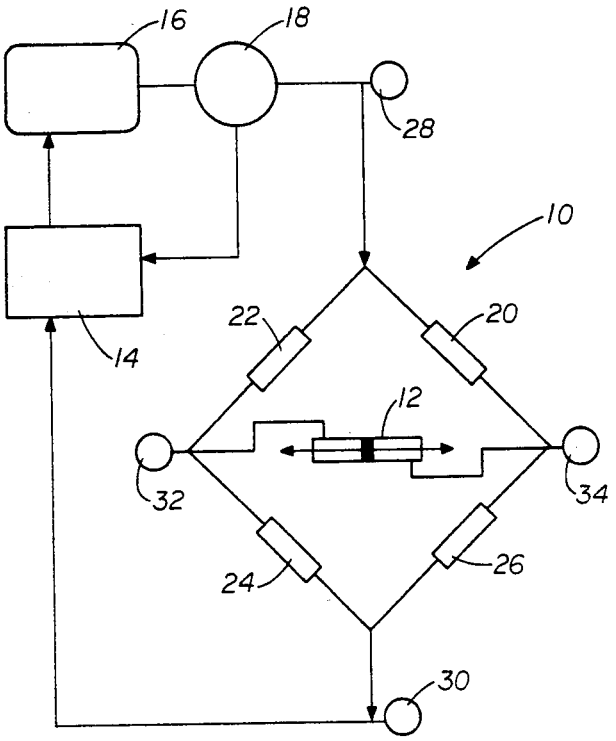
FIG. 1 is a flow diagram of the new valve and associated hydraulics.

Illustrated in FIG. 1 is a schematic diagram of the "Wheatstone Bridge" valve generally denoted by 10, a double acting cylinder or rotary actuator 12, reservoir tank 14, hydraulic pump 16 and adjustable pressure relief valve 18. The bridge valve 10 comprises four separate valves 20, 22, 24 and 26, and an inlet port 28, outlet port 30 and a pair of cylinder ports 32 and 34. Simultaneous actuation of valves 20 and 24 causes flow through valves 22 and 26 and movement of the cylinder 12 piston to the right. Conversely, if valves 22 and 26 are simultaneously actuated there is flow through valves 20 and 24 and movement of the cylinder 12 piston to the left. Such abridge valve 10 might be constructed with conventional hydraulic valves such as solenoid valves and a conventional hydraulic fluid. However, such a bridge valve would be relatively heavy, bulky and slow acting in comparison with the new bridge valve electrorheological fluid combination disclosed below.

Figure 2:
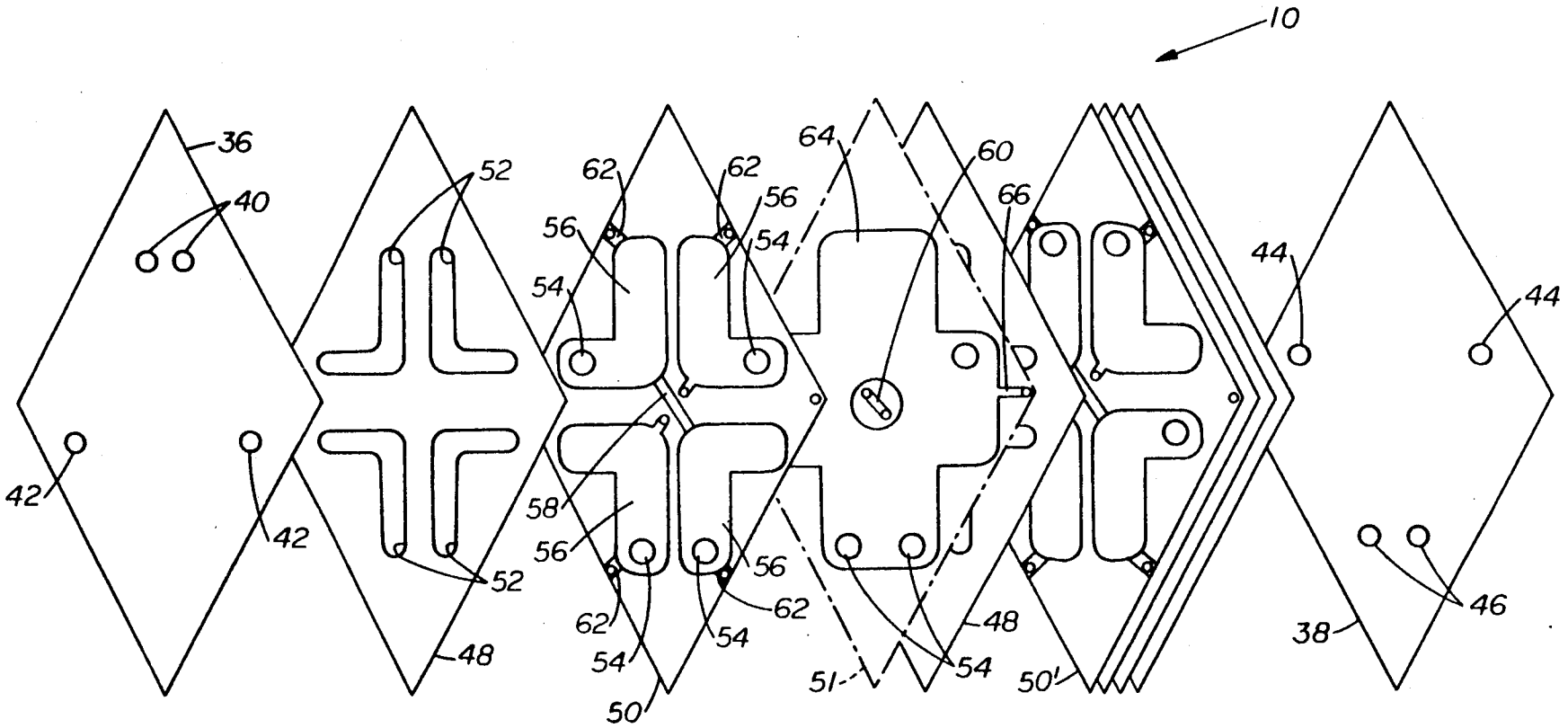
FIG. 2 is an exploded view of a first embodiment of the valve.

FIG. 2 shows the first embodiment of the new electrorheological fluid plate valve 10 exploded or partially unstacked to illustrate the internal structure. Although the stacked plates appear diamond shaped in perspective, the faces of the plates are square. The valve concept, however, is not limited to square plates and other plate shapes may be selected as being more appropriate for a specific purpose. This embodiment employs cover plates 36 and 38 having inlet ports 40 an outlet ports 42 in cover plate 36 and cylinder or actuator ports 44 and 46 in cover plate 38. Between the cover plates 36 and 38 are a plurality of channel plates 48 alternating with printed circuit board plates. 50. An odd number of printed circuit board plates 50, one less than the number of channel plates 48, are provided. An even number of printed circuit board plates 50 can be included if cover plate 38 is inverted from the position shown. The exact number of plates is determined by the particular application, and such factors as the channel plate thickness, electrorheological fluid characteristics and voltage breakdown limitations of the printed circuit board plates. The channel plates 48 and printed circuit board plates 50 may be about one sixteenth (1.6 mm) inches in thickness and the cover plates about one quarter inches (6.4 mm) in thickness, for example. Thicknesses are not shown in FIG. 2 for purposes of clarity.

The channel plates 48 are formed with four L-shaped or V-shaped channels 52 piercing the plate. The printed circuit board plates 50 are pierced with holes 54 to provide fluid communication through the plates 50 and therefore between channel plates 48 to either side of the printed circuit board plates. 50. The printed circuit board plates 50 are alternatingly reversed top for bottom as shown by plate 50' thus providing flow through each leg of each L-shaped channel 52 in each channel plate 48. The channel plates 48 are constructed of an electrically insulating material. Non-conducting fiber reinforced plastics are suitable.

The printed circuit board plate 50 is constructed of a suitable electrically insulating material such as reinforced epoxy resin onto which conductive printed circuit patterns can be applied. The printed circuit board plate 50 of FIG. 2 comprises an anode side having four separate L-shaped or V-shaped electrode surfaces or pads 56 corresponding to the L or V-shaped channels 52. For the "Wheatstone Bridge" circuit of the valve the pads 56 are cross connected by the printed circuit trace 58 and the printed circuit through hole trace 60 shown on the ghosted backside 51 of the printed circuit board plate 50. Thus, in FIG. 2 ghosted plate 51 is the "flipped over" backside of plate 50. High voltage electrical connection traces 62 extend to the edges of the printed circuit board plates 50 for connection to the external electric controls of the valve. Each pad 56 includes a high voltage trace 62 so that the external electric connection to the pads 56 can be along single lines on the outside of the valve despite the top for bottom reversal 50' of alternating printed circuit board plates 50.

On the back side 51 of the printed circuit board plate 50 is relatively large pad 64 which serves as ground electrode. The ground pad 64 includes a printed circuit trace 66 to a corner of the plate 50 for external electrical connection to the ground pad. At the tips of the traces 62 and 66 are printed circuit through holes or other means adapted to permit electrical attachment to the external electric controls. Only one design for the channel plates 48 and one design for the printed circuit board plates 50 are required regardless of the number of plates stacked in the valve 10 thus greatly minimizing manufacturing costs and permitting automated assembly of the valves. The valve 10 of FIG. 2 requires one less printed circuit board plate 50 than the number of channel plates 48. Moreover, the number of external electrical connections are minimized as are the number of external ports.

Because of the relatively low pressure differential across each printed circuit board late 50, the forces acting transverse to each plate 50 are minimal and in many applications standard printed circuit board epoxy resin substrates can be used. As shown the pads 56 and 64 are substantially larger than the channels 52. Because the channel plates 48 and printed circuit board plates 50 are very tightly stacked and clamped together (now shown) the pads 56 and 64 also serve as gaskets to provide sealing against fluid pressure in the channels 52.

The relatively thick cover plates 36 and 38 permit tapping for threaded connections to the ports 40, 42, 44 and 46 and provide sufficient strength to prevent distortion and consequent leakage between the plates in the valve 10. Clamping may be provided by external tie rods or tie rods passing through additional aligned holes in the complete stack of plates. The aligned hole pattern will in part be dictated by the channel pattern for uniform clamping forces.

In the design of the valves, other layouts of the channels and electrodes are possible to adjust electrical capacitance and fluid flow variables. The effective length of the path between electrodes can be adjusted by changing the number of plates. The pressure drop across the valve can be adjusted by the selection of channel plate 48 thickness and channel 52 width. Because of the fractional pressure drop channel plate 48 to channel plate, the pressure drop across each printed circuit board plate 50 is minimal and the structural strength requirement is minimized. Capacitance can be decreased by replacing the solid electrode pads 56 and 64 with stripped pads to reduce total area and improve response time.

Figure 3:
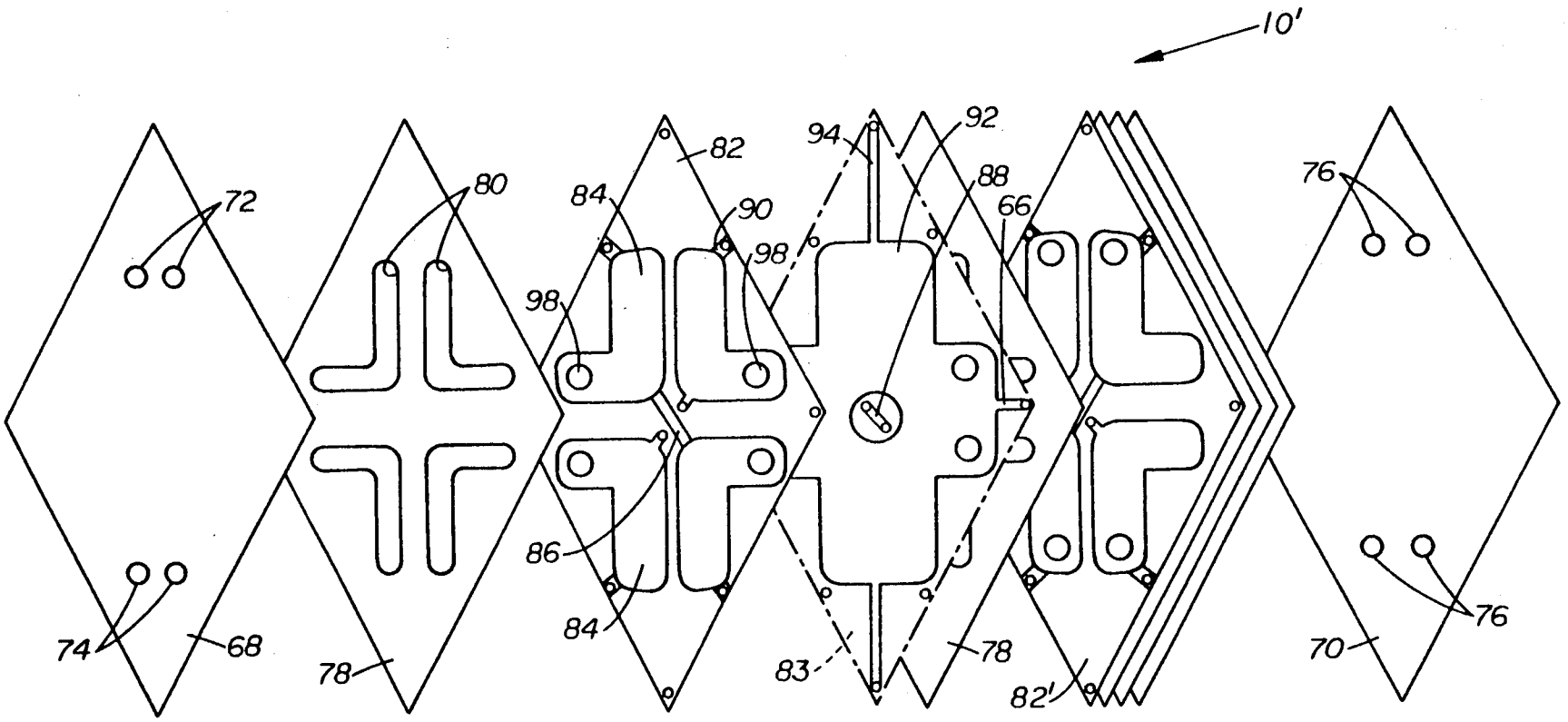
FIG. 3 is a modified orifice location form of the valve shown in FIG. 2.

FIG. 3 illustrates a variation 10' on the valve to FIG. 2 that simplifies external porting. In this embodiment the cover plates 68 and 70 are identical and symmetrical with respect to the inlet 72 and outlet 74 ports in cover plate 68 and actuator ports 76 in cover plate 70. The channel plates 78 can be identical to those shown in FIG. 2 with L-shaped or V-shaped channels 80 piercing the plate. The printed circuit board plates 82, however, are modified to accommodate the different cover plate porting.

The anode pads 84 with the internal crossed connection traces 86 and 88 and the high voltage electric connection traces 90 on the front face of the printed circuit board plate 82 remain the same as in FIG. 2. However, on the back side 83 of the plate 82 although the ground pad 92 remains the same as in FIG. 1, two printed circuit traces 94 extending to the top and bottom corners of the printed circuit board plate back 83 are provided in addition to the ground traces 66 corresponding to the ground traces 66 in FIG. 2. The traces 90, 94 and 66 that extend to the edges of the printed circuit board plates 82 are aligned from cover plate 68 to cover plate 70 excluding the cover plates and channel plates immediately adjacent the cover plates. External connections can be simply accomplished by plating over the plate 82 edges at the traces and brazing and external strip thereto.

The holes 98 through the printed circuit board plate 82 provide fluid communication between channel plates 78. The external port configuration requires that the holes 98 be paired in adjacent tips of the pads 84. By rotating the printed circuit board plate 82 90° for the plate position at 82' the location of the holes 98 rotates 90° and the same holes 98 provide for flow through the legs of the channels 80. Only three dissimilar plate types are required: cover plate, channel plate and printed circuit board plate.

Figure 4:
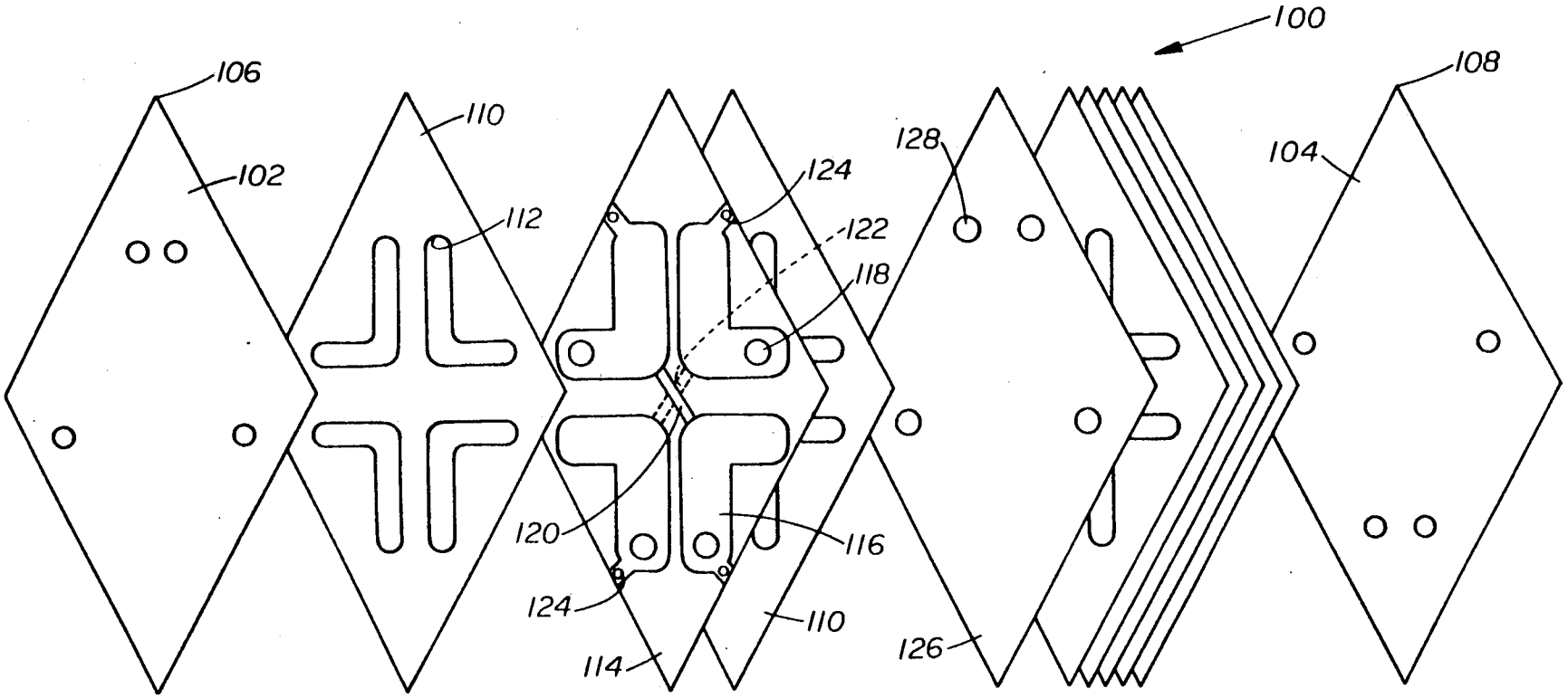
FIG. 4 is an alternate multiple ground plate form of the valve shown in FIG. 2

Illustrated in FIG. 4 is an alternate form 100 of the fluid plate valve wherein the printed circuit board plates are printed with active identical electrodes on both sides and separate ground plates are provided. In this embodiment the front 102 and back 104 cover plates are electrically conductive and are each connected to ground at one corner 106 or 108. As shown the back cover 104 is merely a front cover turned 180° as with other embodiments shown. The channel plates 110 comprise a non-electroconductive material pierced by four L-shaped or V-shaped channels 112 as previously disclosed above. Although the channel plates 110 and those in the above embodiments 48 and 78 have been shown with L-shaped or V-shaped channels, the new "Wheatstone Bridge" valve is not restricted to strictly L-shaped or V-shaped channels but rather the channels may be shaped as necessary for the overall passage configuration desired.

The printed circuit board plates 114 of FIG. 4 comprise the electrically conductive patterns 116 on both sides corresponding to the channels 112 and oversize the create a seal about the channels when the plates are clamped together. Holes 118 pierce the printed circuit board plates 114 to provide fluid communication between the channels 112 in the adjacent channel plates 110. The holes 118 are through plated electrically connect the patterns 116 on opposite sides of the plate 114. Electrically conductive trace 120 cross-connects two patterns 116 for the paired valves of the "Wheatstone Bridge" arrangement on one side. Trace 122 on the opposite side of the plate is connected with the other set of valve patterns 116 on the other side of the plate 114. Also, as above high voltage electrical traces 124 extend to the edges of the printed circuit board plates 114. Although with the cross-connect traces 120 and 122 in this embodiment two of the traces 124 appear to be superfluous, as an alternative the cross-connect traces can be used for an alternative version of the FIG. 4 valve that corresponds to the valve of FIG. 3.

Alternating with the printed circuit board plates 114 between the channel plates 110 are interior ground plates 126 of an electrically conductive material. The ground plates 126 are pierced with holes 128 for fluid communication between channels in channel plates 110 to either side of the ground plates 126. The interior ground plates 126 may be identical to but thinner than the cover plates 102 and 104 with the exception of hydraulic fittings (not shown) welded, brazed or otherwise affixed to the cover plates for the necessary connection to the external hydraulic circuit. The ground plates 126 and cover plates 102 and 104 may simply be thin stamped metal sheets, however, in most applications the cover plates 102 and 104 will be considerably thicker to withstand and make uniform the clamping forces on the valve 100.

Figure 7:
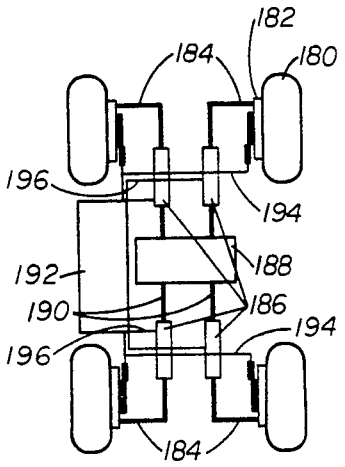
FIG. 7 illustrates the application of the new valve to an anti-lock braking system (ABS) for a vehicle.
Figure 6:
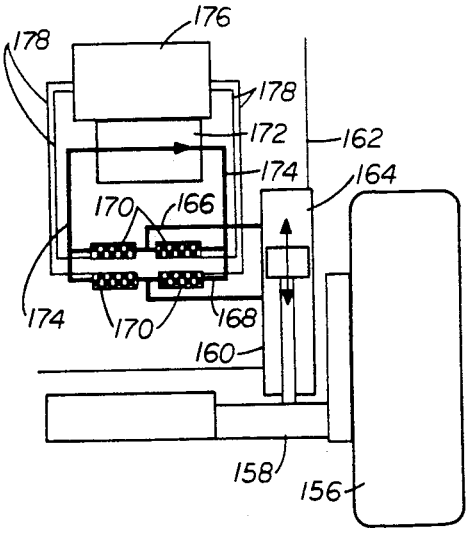
FIG. 6 illustrates the application of the new valve to an active automotive suspension system.
Figure 5:
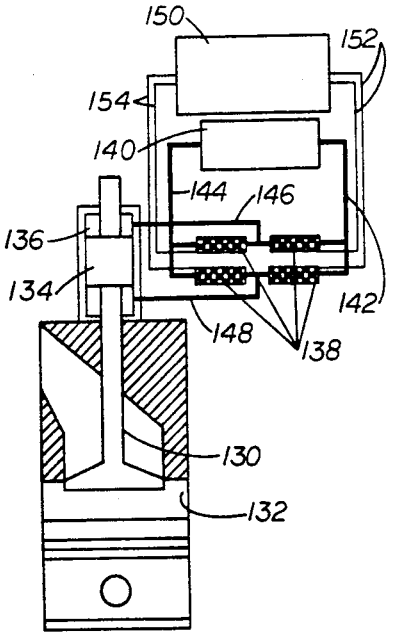
FIG. 5 illustrates the application of the new valve to an internal combustion engine.

FIGS. 5, 6 and 7 illustrate briefly three important applications of the new valve. In FIG. 5 a poppet valve 130 for a cylinder 132 in an internal combustion engine is hydraulically opened and closed by the attached piston 134 in a chamber 136. The new electrorheological valve comprises the four bridge connected control valves 138 connected to a source 140 of hydraulic fluid under pressure in a circuit through conduits 142 and 144. The conduits 146 and 148 provide the hydraulic outputs from the new valve to the chamber 136. An electronic (microprocessor) control 150 is electrically connected 152 and 154 to the electrodes of the four bridge valves 138. Because of the quickness with which electrorheological fluids react to an electric field, the electronic control 150 can cause the poppet valve 130 to open and close in proper timing for the engine.

In FIG. 6 a wheel 156 and under carriage 158 are connected through an active damper/linear actuator 160 or shock absorber to a vehicle 162. The cylinder chamber 164 is hydraulically connected through conduits 166 and 168 to the output ports of the new electrorheological valve 170. The new valve 170 in turn is connected to a source 172 of hydraulic fluid under pressure in an hydraulic circuit 174 and is electrically connected to an electronic (microprocessor) control 176 through connection circuit 178. Thus, the effective damping and vertical position of the shock absorber may be almost instantaneously adjusted for road conditions, vehicle motion and vehicle load as sensed by accelerometers and tilt sensors.

In FIG. 7 independent four wheel brake control is illustrated for an advanced anti-lock braking system. Each wheel 180 and associated brake 182 is hydraulically connected 184 to a separate new electrorheological valve 186 through the output ports of each new valve. In turn each of the four new valves 186 is connected 190 through its input ports to the power brake module 188 of the vehicle. Thus, the power brake module 188 provides the source of hydraulic pressure to operate each brake 182.

Each wheel 180 and brake 182 includes a wheel speed sensor connected 194 electrically to an electric brake control (microprocessor) 192 which continuously monitors each wheel speed and senses wheel skid. The electric brake control 192 separately controls each new valve 186 and therefore each brake 182. By almost instantaneously changing the flow of an electrorheological brake fluid through the new valve 186 brake pressure can be released from and applied to a skidding wheel. In the event of electrical failure the brakes will function normally but absent the anti-skid feature.

Figure 8:
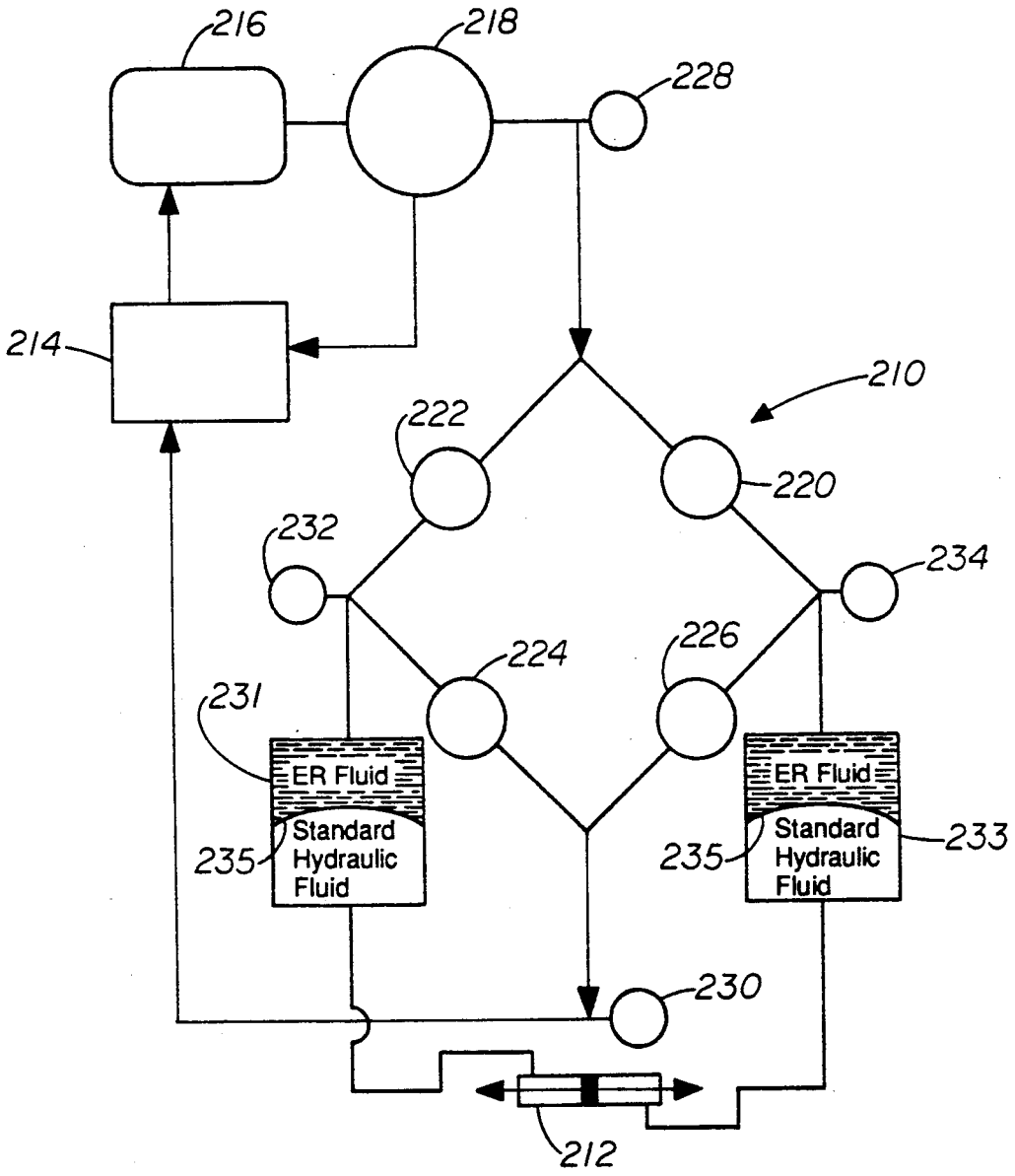
FIG. 8 is a flow diagram of the new valve in a hybrid hydraulic circuit.

In certain applications a standard or conventional hydraulic fluid may be desired in the hydraulic cylinder, rotary actuator or other power transmission device. FIG. 8 illustrates a pair of fluidic diaphragm separators inserted in a hydraulic circuit otherwise the same as that illustrated in FIG. 1. As above the circuit comprises a "Wheatstone Bridge" valve generally denoted by 210, a double acting cylinder or rotary actuator 212, reservoir tank 214, hydraulic pump 216 and adjustable pressure relief valve 218. Also as above, the bridge valve 210 comprises four separate internal valves, 220, 222, 224 and 226, and an inlet port 228, outlet port 230 and a pair of cylinder ports 232 and 234. Inserted in each leg of the circuit between cylinder ports 232 and 234 respectively and the cylinder or rotary actuator 212 are the fluidic diaphragm separators 231 and 233. Within each separator is a flexible diaphragm 235 that physically separates the electrorheological fluid in the bridge valve 210 from the standard hydraulic fluid used to directly power the cylinder or rotary actuator 212. The diaphragm 235 in each separator 231 or 233 operates in a manner similar to a hydraulic accumulator, however, the fluids on both sides of the diaphragm 235 are substantially incompressible liquids. The hybrid circuit of FIG. 8 has applications where the electrorheological fluid might become contaminated or might contaminate or damage the cylinder or rotary actuator. The former might occur in radioactive environments, for example, and the latter might occur with abrasive particles in the electrorheological fluid acting on shaft and piston seals. The hybrid circuit reduces the effect of electrorheological fluid particle settling in stagnant passages and, also, a savings in expensive electrorheological fluid might arise where the bridge valve is located far from the cylinder or rotary actuator.

The new valve is also applicable to robotics because the hydraulic energy can be precisely used to control manipulators and effectors for linear and rotational movement. The new valve offers unusual opportunities because, with printed circuit board manufacturing technology the entire valve can be reduced to a very tiny size and thereby placed close to the actuator controlled by the valve. At the other extreme, the valve can be made very large for large throughput quantities of electrorheological fluid to operate hydraulic actuators on aircraft and earthmoving equipment. Since, in either extreme the new valve may be constructed principally of reinforced plastics, the valve can be light in weight for its capacity.

I claim:

1. An electrorheological fluid valve comprising a plurality of flat plates, at least one of the plates non-electroconductive and formed with a plurality of channels that direct movement of fluid therein generally in the direction of the plane of the plate, second and third plates with sides in contact with the non-electroconductive channel plate sides, the second and third plates each having electroconductive surfaces facing the non-electroconductive channel plate, a pair of the electroconductive surfaces on at least one of the second and third plates in electrical communication therebetween and facing at least one pair of channels and a separate second pair of the electroconductive surfaces on at least one of second and third plates in electrical communication therebetween and facing a second pair of channels.

2. The electrorheological fluid valve of claim 1 including electroconductive surfaces on both sides of each of the second and third plates.

3. The electrorheological fluid valve of claim 2 wherein the electroconductive surface on one side of one of the second and third plates faces both pairs of channels to form an electrical ground surface for both pairs of channels.

4. The electrorheological fluid valve of claim 3 wherein the paired electroconductive surfaces on the other of the second and third plates face the electrical ground surface in opposition thereto through the paired channels.

5. The electrorheological fluid valve of claim 4 wherein the paired channels are in fluid communication through fluid conduits and ports to form a fluid "Wheatstone Bridge" circuit, the paired channels forming the paired valves on opposites sides of the bridge.

6. The electrorheological fluid valve of claim 2 wherein each pair of electroconductive surfaces on one side of one of the second and third plates is in electrical communication with a second pair of electroconductive surfaces on the other side of the same plate and the other of the second and third plates includes electroconductive surfaces on both sides of the plate, one of the surfaces facing both pair of channels to form an electrical ground surface for both pairs of channels.

7. The electrorheological fluid valve of claim 1 wherein the second and third plates include holes therethrough to provide fluid communication between channel plates separating second and third plates.

8. The electrorheological fluid valve of claim 7 wherein the second and third plates are substantially identical but rotated 90° relative to each other in placement to either side of the channel plate therebetween.

9. The electrorheological fluid valve of claim 7 wherein the second and third plates are substantially identical but rotated 180° relative to each other in placement to either side of the channel plate therebetween.

10. The electrorheological fluid valve of claim 1 wherein the electroconductive surfaces extend beyond the peripheries of the channels in the channel plates to thereby form fluid sealing means about the channels.

11. An internal combustion engine including a plurality of poppet valves, said poppet valves movable in response to hydraulic actuators and said hydraulic actuators in fluid communication with a plurality of electrorheological fluid valves as claimed in claim 1.

12. An active hydraulic damper and linear actuator system comprising an electrorheological fluid valve as claimed in claim 1 in fluid communication with a source of pressurized fluid and with the hydraulic damper and linear actuator, said electrorheological valve in electric communication with control means to adjust the effective damping and position in response to sensors.

13. An advanced braking system comprising at least one brake and rotatable means connected thereto, an electrorheological fluid valve as claimed in claim 1 in fluid communication with the brake and with a hydraulic brake module, said electrorheological valve in electric communication with control means to adjust the brake load applied to the rotatable means in response to sudden changes in the rotational velocity of the rotatable means.

14. A fluid circuit comprising an electrorheological fluid valve as claimed in claim 1 and further including means in the circuit to physically separate an electrorheological fluid in the valve from a con-electrorheological fluid in another portion of the circuit.

15. An electrorheological fluid valve comprising a plurality of alternating channel plates and electrode plates stacked in arrangement, the channel plates each pierced by a plurality of channels formed to cause fluid flow therein to be guided substantially in the plane of the channel plate, the electrode plates including electroconductive surfaces thereon facing the channels in the channel plates and including holes piercing the electrode plates for fluid communication between channels in channel plates to either side of the individual electrode plates, wherein the plurality of channel plates are identical and the plurality of electrode plates include conductive means connecting pairs of electroconductive surfaces on at least some of the electrode plates.

16. The electrorheological fluid valve of claim 15 wherein the electroconductive surfaces extend beyond the peripheries of the channels in the channel plates to thereby form fluid sealing means about the channels.

17. The electrorheological fluid valve of claim 15 wherein the electrode surfaces on one side of each electrode plate are active and at least one electrode surface on the opposite side of the plate is grounded.

18. The electrorheological fluid valve of claim 15 wherein the electrode plates comprise alternating active electrode plates and ground plates, the active electrode plates having active electrode surfaces on both sides and the ground plates having grounded electrode surfaces on both sides.

19. The electrorheological fluid valve of claim 15 wherein the electrode surfaces on the same side of at least some of the electrode plates are electrically connected in pairs to form at least one "Wheatstone Bridge" fluid valve circuit within the valve.

20. The electrorheological fluid valve of claim 15 wherein the channel plates are formed on non-electroconductive material and at least some of the electrode plates are formed of non-electroconductive material, the electrode surfaces being applied thereto.

21. A fluid circuit comprising an electrorheological fluid valve as claimed in claim 14 and further including means in the circuit to physically separate an electrorheological fluid in the valve from a non-electrorheological fluid in another portion of the circuit.

* * * * *